US007556029B2

(12) United States Patent
Naito et al.

(10) Patent No.: US 7,556,029 B2
(45) Date of Patent: Jul. 7, 2009

(54) OIL SEPARATOR FOR AN ENGINE

(75) Inventors: Masahiro Naito, Hiroshima (JP); Satoshi Tateishi, Hiroshima (JP); Takashi Sasada, Higashihiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 11/781,768

(22) Filed: Jul. 23, 2007

(65) Prior Publication Data

US 2008/0047519 A1 Feb. 28, 2008

(30) Foreign Application Priority Data

Aug. 22, 2006 (JP) ..... 2006-225430

(51) Int. Cl.
*F01M 13/14* (2006.01)

(52) U.S. Cl. ..... 123/572

(58) Field of Classification Search ..... 123/572–574, 123/41.86, 193.5, 193.3
See application file for complete search history.

(56) References Cited

U.S. PATENT DOCUMENTS

| | | | | | |
|---|---|---|---|---|---|
| 4,403,579 | A * | 9/1983 | Young et al. | ..... | 123/146.5 A |
| 4,493,295 | A * | 1/1985 | Ampferer | ..... | 123/41.86 |
| 4,602,607 | A * | 7/1986 | Balsley | ..... | 123/574 |
| 4,607,604 | A * | 8/1986 | Kanoh et al. | ..... | 123/572 |
| 5,184,401 | A * | 2/1993 | Hirose et al. | ..... | 29/888.01 |
| 5,944,001 | A * | 8/1999 | Hutchins | ..... | 123/572 |
| 6,029,638 | A * | 2/2000 | Funai et al. | ..... | 123/572 |
| 6,237,577 | B1 * | 5/2001 | Takahashi et al. | ..... | 123/572 |
| 6,394,079 | B2 * | 5/2002 | Takada et al. | ..... | 123/572 |
| 6,412,478 | B1 * | 7/2002 | Ruehlow et al. | ..... | 123/572 |
| 2001/0025633 | A1 * | 10/2001 | Takada et al. | ..... | 123/572 |
| 2002/0017283 | A1 * | 2/2002 | Furuya | ..... | 123/573 |
| 2005/0011503 | A1 | 1/2005 | Deane et al. | | |

FOREIGN PATENT DOCUMENTS

| | | | |
|---|---|---|---|
| EP | 1482136 | * | 12/2004 |
| FR | 2758365 | * | 7/1998 |
| JP | 06123212 A | * | 5/1994 |
| JP | 2003301710 | | 10/2003 |
| JP | 2005048601 | | 2/2005 |
| JP | 2005163631 | | 6/2005 |
| JP | 2006177258 | | 7/2006 |

* cited by examiner

*Primary Examiner*—M. McMahon
(74) *Attorney, Agent, or Firm*—Alleman Hall McCoy Russell & Tuttle LLP

(57) ABSTRACT

An internal combustion engine, comprising, a cylinder head; a rotational shaft supported by said cylinder head and lubricated; a head cover arranged on said cylinder head; an end member arranged at an axial end of said rotational shaft; a first chamber defined at least by said cylinder head and said end member and accommodating said rotational shaft; a second chamber defined at least by said head cover and having an opening to said first chamber; and a baffle integrally formed with said end member and extending in an axial direction of said rotational shaft between said opening and said rotational shaft in a radial direction of said rotational shaft.

22 Claims, 12 Drawing Sheets

OIL SEPARATOR FOR AN ENGINE

CROSS REFERENCE TO RELATED APPLICATIONS

This application claims foreign priority to Japanese Patent Application No. 2006-225430, filed Aug. 22, 2006.

BACKGROUND

The present description relates to an oil separator to separate oil contents from blow-by gases of an internal combustion engine, and particularly relates to an oil separator which is arranged on a cylinder head of the engine.

When an air-fuel mixture is combusted in the engine combustion chamber, a small portion of the combusted gas may go into the engine crankcase through the piston rings. This is referred to as blow-by gas, but it is essentially engine exhaust gas. Therefore, the gas needs to be prevented from going out directly to the atmosphere. Thus, for example, by communicating the crankcase with the engine intake system at a lower pressure, the blow-by gas is caused to flow from the crankcase to the engine intake system and caused to be mixed with fresh air. Then, it is inducted into the combustion chamber for re-combustion.

Engine lubrication oil is supplied into the crankcase at a higher pressure for lubricating moving parts. That higher pressure causes some of the supplied oil to be in a mist form in the crankcase. The oil mist may mix with the blow-by gas. If the blow-by gas containing the oil mist is returned to the intake system, the oil content may be combusted in the combustion chamber. This may cause the oil consumption to increase, or it may cause disadvantageous effects on the engine exhaust system.

An oil separator is disclosed, for example, in Japanese Patent Application Publication JP2003-301710A to separate oil content from the blow-by gas containing the oil mist. When the blow-by gases flow through a bending passage made with baffles, for example, a difference of kinetic energies between gases and liquids separates the liquid form of the oil content from the blow-by gas containing the oil mist. The oil content is returned to the engine lubricating system, and the blow-by gas is returned to the engine intake system as described above.

An oil separator chamber disclosed in the '710 publication is arranged in a valve drive chamber defined between a cylinder head and a head cover. The valve drive chamber is in fluid communication with the crankcase and the intake system so that the blow-by gas may flow from the crank case to the intake system. A camshaft and other moving parts are lubricated with the engine oil in the valve chamber. Therefore, the gas in the valve drive chamber may contain more of the oil content even though some of the oil content has been separated from the gas during the course of flow from the crankcase to the valve drive chamber. To sufficiently separate the oil content from the blow-by gas in the valve drive chamber, the oil separator chamber of the '710 publication has a gas communication opening for communicating with the valve drive chamber at its one end and another opening to the intake system at the opposite end, thereby maximizing the oil separator passage length.

For example, when the engine is used for a vehicle, such as an automotive vehicle, the engine size is required to be smaller for package constraints of an engine room. For this requirement, the communication opening of the oil separator chamber may be located closer to the camshaft. In the valve drive chamber, the camshaft rotates and splashes the oil. Due to the closer distance between the communication opening and the camshaft, the splashed oil may go into the oil separator chamber through the communication opening. At the same time, the blow-by gas may flow through the communication chamber, and some of the splashed oil may mix with the blow-by gas. Consequently, the oil concentration in the blow-by gas may increase, and degrade the oil separator performance.

SUMMARY

Accordingly, there is provided, in a first aspect of the present description, an internal combustion engine comprising a cylinder head, a rotational shaft supported by the cylinder head and lubricated, a head cover arranged on the cylinder head, an end member arranged at an axial end of the rotational shaft, a first chamber defined at least by the cylinder head and the end member and accommodating the rotational shaft, a second chamber defined at least by the head cover and having an opening to the first chamber, and a baffle. The baffle is integrally formed with the end member and extends in the axial direction of the rotational shaft between the opening and the rotational shaft in a radial direction of the rotational shaft.

According to the first aspect, the baffle is between the opening of the second chamber and the lubricated rotational shaft in the radial direction of the rotational shaft, or the direction of the oil splash. Therefore, the oil splashing from the rotational shaft can be prevented from going into the second chamber. Further according to the first aspect, the baffle is integrally formed with the end member that is arranged at the axial end of the rotational shaft. The opening can be readily arranged at the axial end of the rotational shaft, thereby maximizing the blow-by gas passage length in the second chamber. Consequently, the oil may be sufficiently separated from the blow-by gas in the second chamber.

In a second aspect of the present description, an internal combustion engine comprises a cylinder head, a rotational shaft supported by the cylinder head and lubricated, a head cover arranged on the cylinder head, a first chamber defined at least by the cylinder head and accommodating the rotational shaft, a second chamber defined at least by the head cover and having an opening to the first chamber, and a baffle. The baffle extends in the axial direction of the rotational shaft, has an arc-shaped cross-section viewed in the axial direction of the rotational shaft, and is located between the opening and the rotational shaft in a radial direction of said rotational shaft. The arc-shaped cross-section of the baffle is positioned with the concave face of the baffle facing the rotational shaft.

According to the second aspect, the baffle can block the splashing oil from the rotational shaft from entering the second chamber. The baffle can be arranged closer to the rotational shaft because the concave face of the arc-shaped cross-section faces the rotational shaft. Therefore, the opening of the second chamber can be arranged closer to the rotational shaft, thereby maximizing blow-by gas passage length in the second chamber. Consequently, the oil may be sufficiently separated from the blow-by gas in the second chamber.

In a third aspect of the present description, an internal combustion engine comprises a cylinder head, a rotational shaft supported by the cylinder head and lubricated, a head cover arranged on the cylinder head, a wall horizontally extending between the cylinder head and the head cover, a first chamber defined at least by the cylinder head and the wall accommodating the rotational shaft, a second chamber defined at least by the head cover and the wall, an opening vertically communicating between the first and second chambers, and a bulge formed continuously with the wall at a periphery of the opening. The bulge has an end surface with an arc shape when viewed from an axial direction of the rotational shaft. The arc shape has its concave face positioned to face the rotational shaft.

In accordance with the third aspect, because the end surface of the bulge formed at the periphery of the opening is arc-shaped and its concave face faces down to the rotational shaft, the bulge may guide the oil, which is introduced into the second chamber from the opening, toward both sides of the bulge because of the arc-shape and gravity. Then, the oil may drop from both sides of the bulge off the rotational shaft. Therefore, the oil dropping from the second chamber may be prevented from contacting the rotational shaft and re-splashing. Consequently, the bulge may reduce the oil entering into the second chamber, and the oil may be sufficiently separated from the blow-by gas in the second chamber.

In embodiments, a connecting shaft may be housed in the end member, and coupled with the rotational shaft through a lubricated coupler, such as a spline coupling. The baffle may be overlapped with the coupler in the axial direction of the rotational shaft so that splashing oil from the coupler can be prevented from going into the second chamber. A sealing member may be arranged at least partly around the end member and configured to seal the first chamber from the outside. Preferably, the baffle has an outer surface contacting with the sealing member, and extends in the axial direction of the rotational shaft. Therefore, during the assembly, the end member and the connecting shaft can be inserted into the hole made between the cylinder head and the head cover while sealing the first chamber.

Further in the embodiments, an inclined bottom surface may be formed on an upper side of the wall defining at least partly the second chamber. The inclined bottom surface may be downwardly inclined toward the bulge in the axial direction of the rotational shaft. On the bottom surface, a groove may be formed and extend in the axial direction of the rotational shaft. Therefore, oil in the second chamber may be drained from the opening while keeping it away from the rotational shaft so as to prevent re-entry of the oil. Also, a groove may be formed to extend around the bulge and end at the opening.

Also in the embodiments, the end surface of the wall may extend downwardly beyond a lower surface of the wall so that the oil splashed from the rotational shaft toward the lower surface of the wall may be prevented from going into the second chamber through the opening.

DETAILED DESCRIPTION

Figure 1:
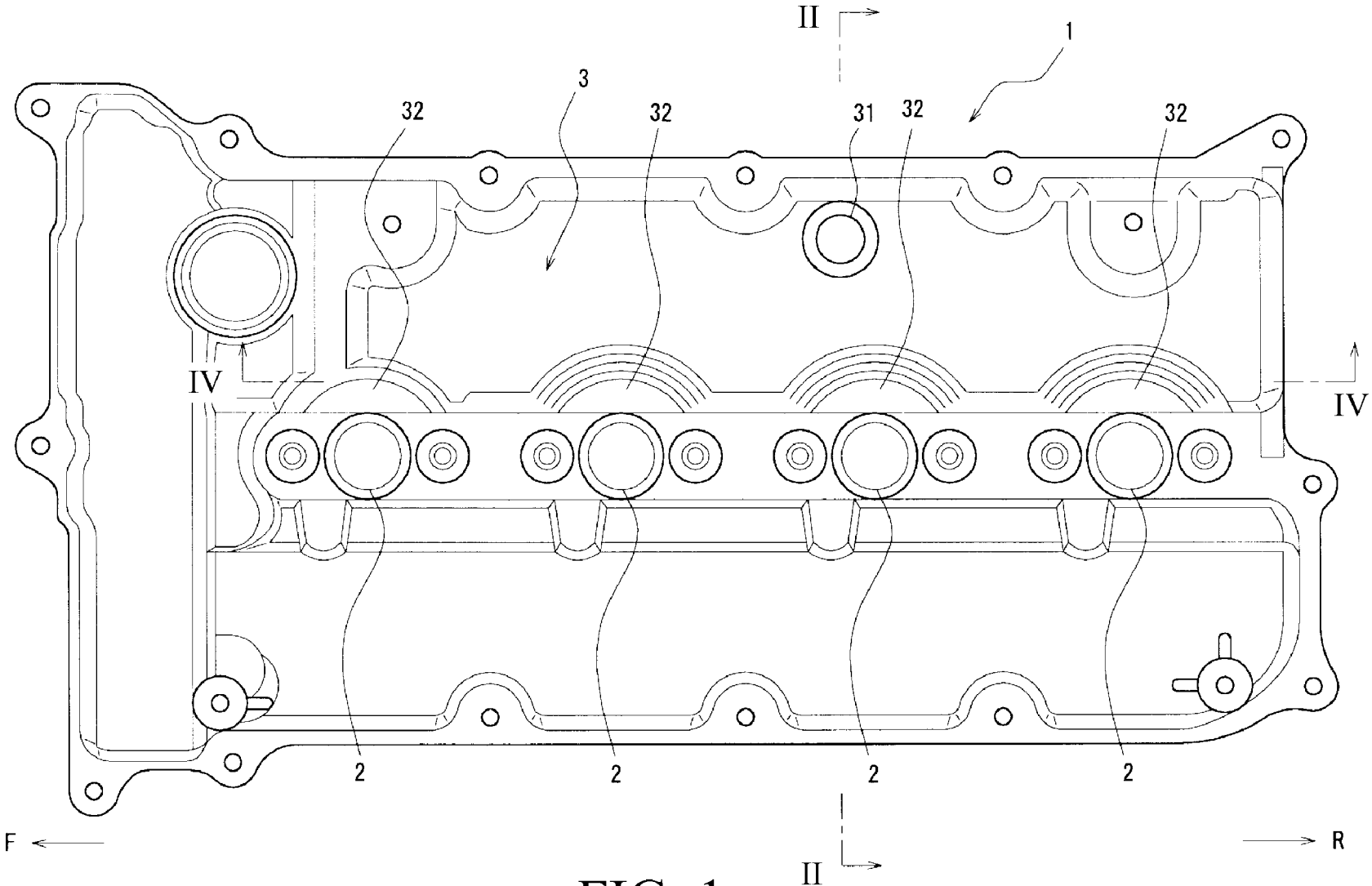
FIG. 1 is a plan view of a cylinder head cover of an engine according to an embodiment of the invention.

Hereinafter, an embodiment of the present invention will be explained in detail based on the drawings. In FIG. 1 and other figures, an arrow (F) indicates the front side of an engine that is not illustrated as a whole, and an arrow (R) indicates the rear side of the engine. It is mounted on a vehicle such as an automotive vehicle in the vehicle longitudinal or lateral direction. In the case of the longitudinal engine mounting, the arrow F indicates the front side of the vehicle.

Figure 2:
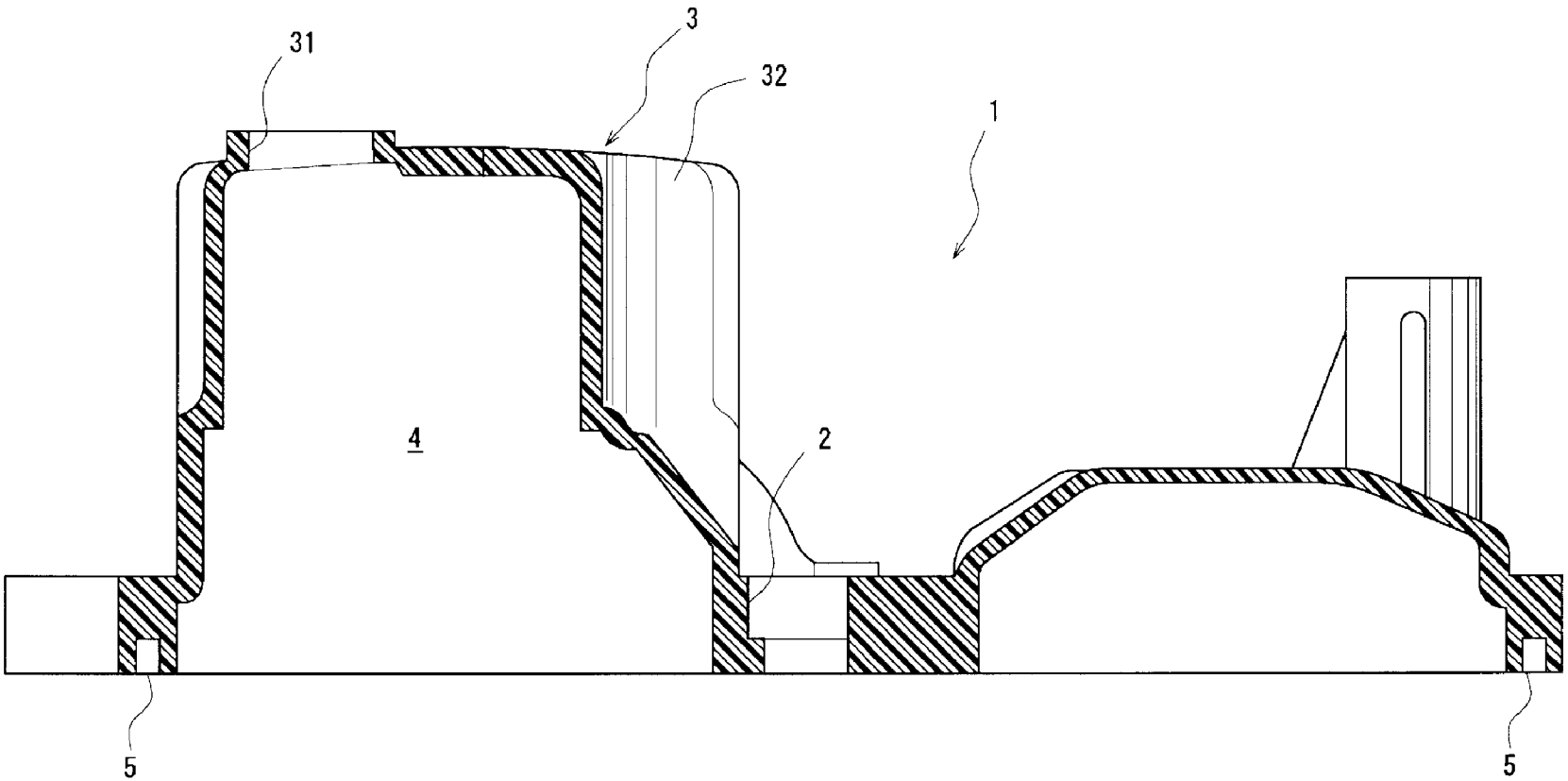
FIG. 2 is a cross-sectional view taken along a line II-II in FIG. 1.

FIG. 1 shows a lower surface of a cylinder head cover 1 for covering a cylinder head 11 of the engine. In some embodiments, the cover may comprise a resin material. Two or more hole portions 2 are formed in the central portion of the cylinder head cover 1 so that they are spaced along a direction in which the cylinders are arranged. Further, a protruded portion 3 that protrudes upwardly is formed in the cylinder head cover 1 on one side thereof as shown in FIG. 2. By this protruded portion 3, a hollow portion 4 is formed inside the protruded portion 3 so that it extends in the longitudinal direction of the cylinder head cover 1. The cylinder head 11 may define a valve drive chamber, also referred to herein as a first chamber. The hollow portion 4, also referred to herein as a second chamber, is defined at least by the cylinder head cover 1 and the cylinder head 11 and has openings 86 and others to the first chamber.

In FIG. 1, four hole portions 2 are formed corresponding to the number of the cylinders, and an injector (not illustrated) for injecting fuel into a combustion chamber of the engine is inserted into each of the plurality of hole portions 2. That is, the illustrated cylinder head cover 1 is fabricated for an in-line four-cylinder engine, and the longitudinal direction of the cylinder head cover 1 corresponds to the engine cylinder raw direction. The directions indicated by the arrows (F) and (R) in FIG. 1 are oriented for the engine onto which the cylinder head cover 1 is mounted, and, thus, "front" and "rear" of the vehicle in this Specification correspond to the arrows (F) and (R), respectively.

As shown in FIGS. 1 and 2, a discharge opening 31 is formed in the protruded portion 3 approximately at a center portion in the longitudinal direction thereof so that the hollow portion 4 communicates with the exterior. Further, on the side of the hole portion 2, recessed portions 32 are formed in a side wall of the protruded portion 3 so that they are recessed inwardly and archwise, corresponding to the positions of the hole portions 2. These are portions formed to prevent the injectors from interfering with the side wall of the protruded portion 3 upon mounting the injectors.

Figure 3:
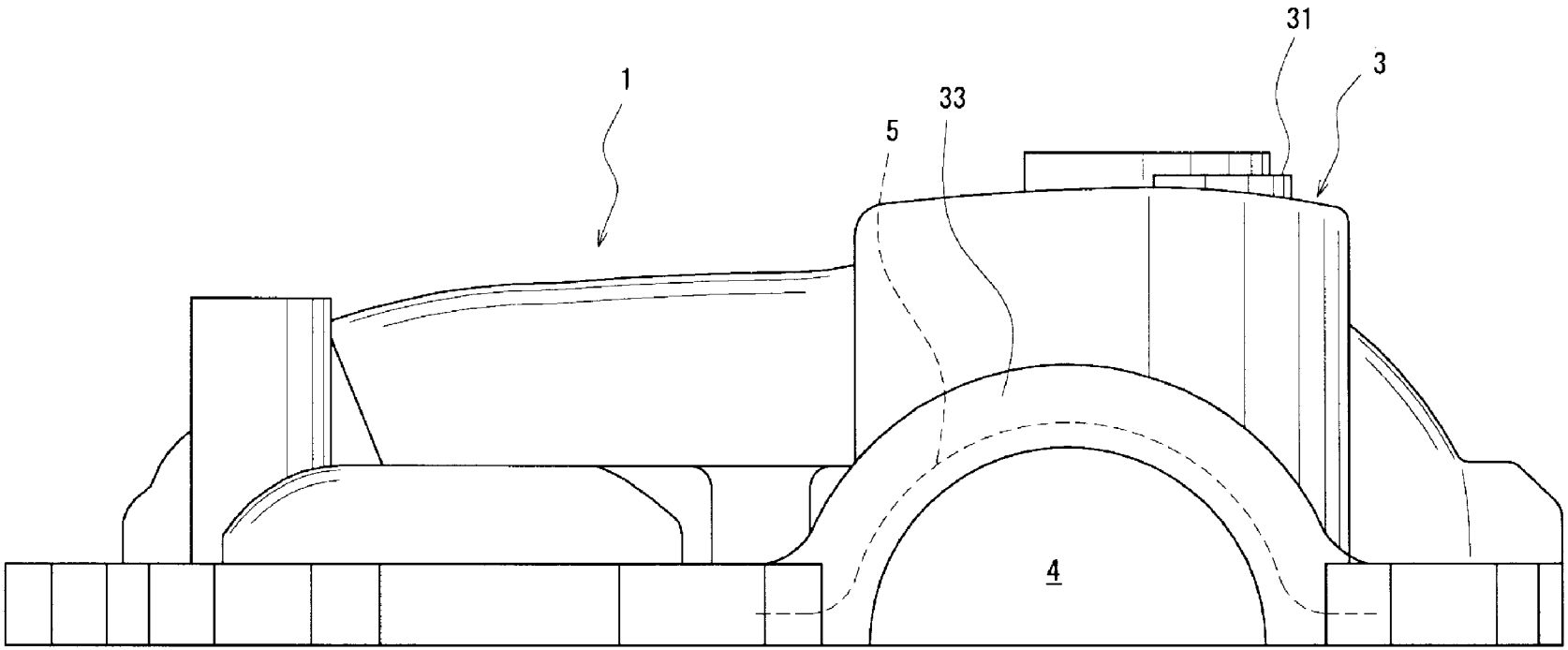
FIG. 3 is a side view showing a rear side of the cylinder head cover of FIG. 1.
Figure 4:
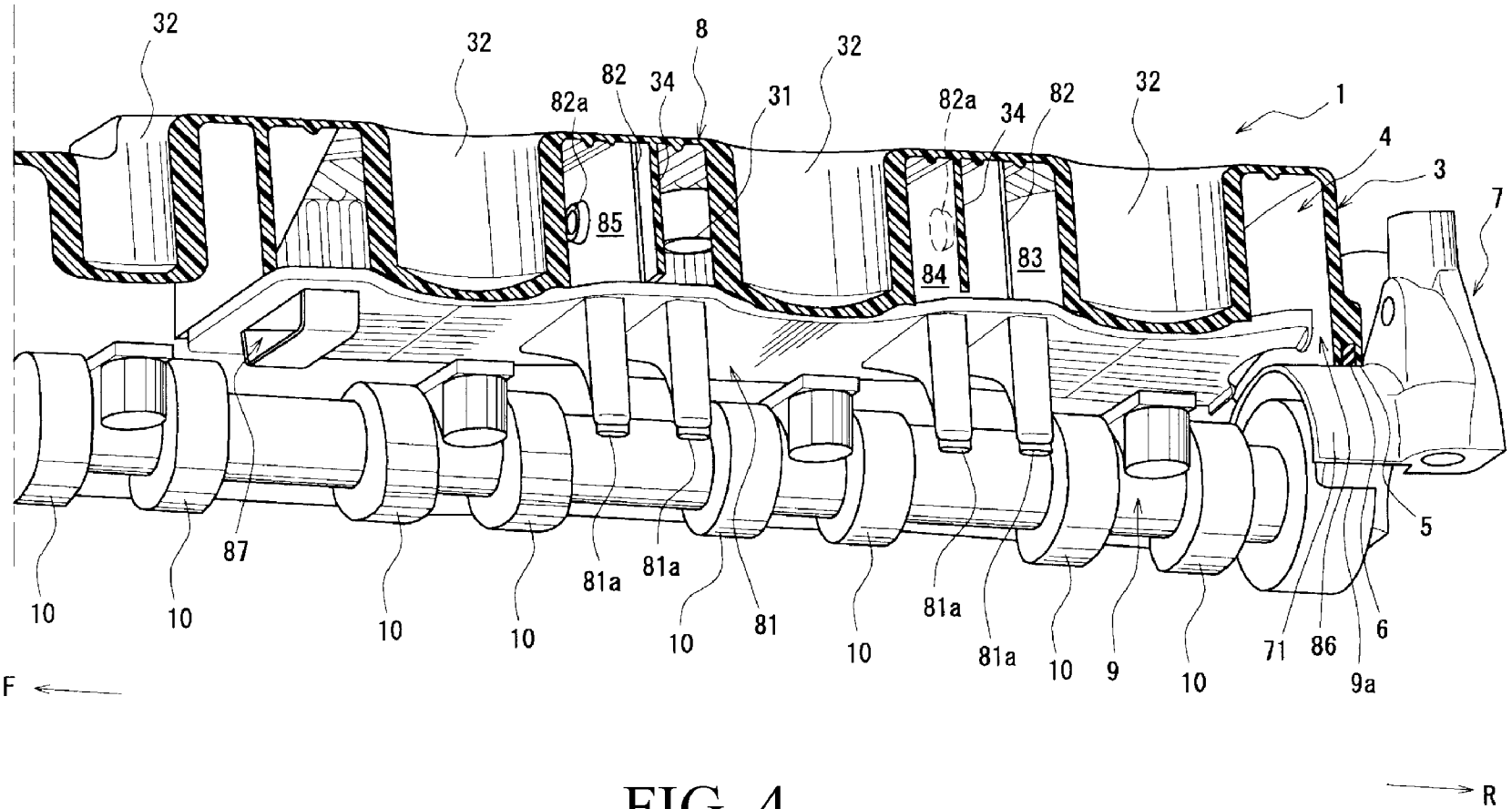
FIG. 4 is a cross-sectional view taken along a line IV-IV in FIG. 1.

As shown in FIG. 3, a recessed portion 33 is formed in a rear end portion of the protruded portion 3 so as to be recessed in a semicircular arc. Here, a groove portion 5 is formed along an edge portion of the cylinder head cover 1 including a portion of the recessed portion 33. A sealing member 6 is inserted in the groove portion 5 as shown in FIG. 4.

It may be possible to mount an auxiliary machine unit such as a fuel pump etc. (not illustrated) to a rear end wall portion of the cylinder head cover 1. The auxiliary machine unit may be shielded by a housing 7 from the exterior. A sealed edge portion for the housing 7 may be formed by the sealing member 6 in the end wall portion of the cylinder head cover 1.

An oil separating device 8 is provided in the cylinder head cover 1, for separating oil mist intermingled in blow-by gas leaked from between the pistons and the engine cylinders during combustion using the hollow portion 4 inside the protruded portion 3, and discharging the oil mist into an air-intake system (not illustrated).

In this embodiment, a lower portion of the oil separating device 8 (the hollow portion 4) is defined by a lower wall plate 81. Three chambers 83, 84, and 85 are defined by partition walls 82 formed with ventilation holes 82*a*, and collision walls 34. The discharge opening 31 is provided to the chamber 84 among these chambers.

A plurality of drain portions 81*a* are formed in the lower wall plate 81 so that they protrude downwardly at the middle of the lower wall plate 81. Introductory opening portions 86 and 87 for introducing the blow-by gas into the oil separating device 8 are formed at both the front and rear ends of the lower wall plate 81.

A rotational shaft 9 shown in FIG. 4 may operate air-intake valves and exhaust valves (not illustrated). Rotational shaft is shown in the depicted embodiment as a camshaft 9, and will be described as such below. However, it will be appreciated that rotational shaft 9 could be another type of rotational shaft. The camshaft 9 is provided with eccentric cams 10 for operating the air-intake valves or exhaust valves. It is supported by the cylinder head 11 through bearing journals in the known manner. The cams 10 are spaced in the axial direction of the camshaft 9 corresponding to the number of cylinders. As illustrated, the camshaft 9 is located below the hollow portion 4 provided with the oil separating device 8. The hollow portion 4 is formed so as to extend in the axial direction of the camshaft 9.

Figure 5:
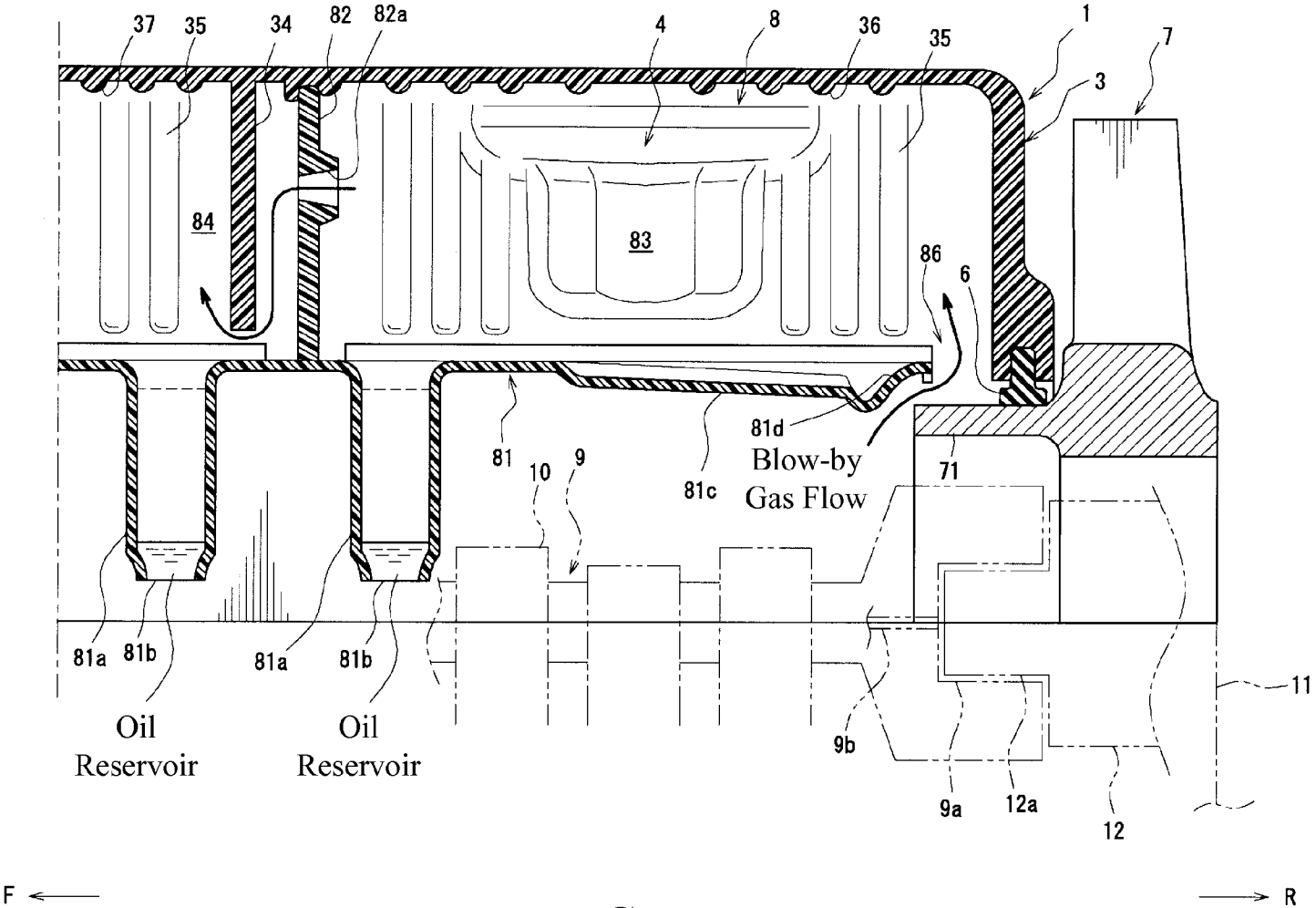
FIG. 5 is an enlarged cross-sectional view showing a proximity to an introductory opening portion of a rear portion of an oil separating device.

FIG. 5 is an enlarged cross-sectional view showing a proximity to the introductory opening portion 86 in the rear portion of the oil separating device 8. In FIG. 5, an illustration of the recessed portion 32 formed in the protruded portion 3 is omitted for convenience. Here, as shown in FIGS. 4 and 5, the introductory opening portion 86 is formed by an end wall portion of the cylinder head cover 1, and an end portion of the lower wall plate 81 on the rear end side in the axial direction of the camshaft 9.

Further, in this embodiment, the rear end portion of the camshaft 9 is located below the introductory opening portion 86, and formed with a concave portion referred to as a concave face 9*a*. The above-mentioned auxiliary machine unit is disposed so that it opposes the rear end portion of the camshaft 9. In some embodiments, a connecting shaft may be coupled with the camshaft 9 through a lubricated coupler, such as a spline coupling. An end portion of the connecting shaft 12 of the auxiliary machine unit shown in FIG. 5 can have a first spline that engages with a second spline on the rear end portion of the camshaft 9. For example, a convex portion 12*a* is formed in the end portion of the connecting shaft 12 corresponding to the concave face 9*a* of the camshaft 9. By engaging the concave face 9*a* and the convex portion 12*a*, a rotational force of the camshaft 9 is transmitted to the connecting shaft 12 and, thus, to the auxiliary machine unit. The camshaft 9 and the auxiliary machine unit (the connecting shaft 12) constitute a rotational drive system. In the meantime, the concave and convex relationship between the concave face 9*a* and the convex portion 12*a* is not limited to as shown in FIG. 5, and may be reversed.

Further, as shown in FIG. 5, an oil passage 9*b* is formed inside the camshaft 9 to supply lubricating oil from the concave face 9*a* to an engaging portion that is between the concave face 9*a* and the convex portion 12*a*.

As shown in FIGS. 4 and 5, a baffle 71 is formed in the housing 7 and has an arch or arc shaped cross section when viewed in the axial direction of the camshaft 9. The baffle 71 extends in the axial direction of the camshaft 9, and is spaced below the introductory opening portion 86. The baffle 71 is located just over the concave face 9*a* and the convex portion 12*a* or the lubricated coupler. The arc shape of the baffle 71 has a concave face positioned to face the coupler and conform to its outer circular shape. The engaging portion or the lubricated coupler between the concave face 9*a* and the convex portion 12*a*, and the auxiliary machine unit are shielded from the exterior by the housing 7 and the sealing member 6, in the rear end portion of the camshaft 9. The housing 7 is provided in an upper surface of a cylinder head 11 that accommodates the camshaft 9, air-intake valves, exhaust valves, etc.

In this embodiment, the blow-by gas leaked during combustion from between the pistons and the cylinders of the engine (not illustrated) passes through the inside of a crankcase (not illustrated), and flows from the introductory opening portions 86 and 87 shown in FIG. 4 into the oil separating device 8. The blow-by gas flows through the chambers 83 and 85 on the upstream side, and through the chamber 84 on the downstream side into the discharge opening 31.

The discharge opening 31 is connected with the air-intake system (not illustrated). The blow-by gas flowed into the oil separating device 8 flows toward the discharge opening 31 by a negative pressure of the air-intake system. During this process of relatively slow flow, the oil mist intermingled in the blow-by gas is separated from the blow-by gas by liquefying a portion thereof on the lower wall plate 81 that naturally drops in the chambers 83 and 85 on the upstream side, and liquefying a portion thereof by contacting the portion with side walls, a ceiling wall, or partition walls 82 of the oil separating device 8.

A ventilation hole 82*a* (a tapered hole with a larger diameter on the upstream side and a smaller diameter on the downstream side with respect to the blow-by gas flow) is formed in the partition wall 82 for guiding the blow-by gas to the center chamber 84 on the downstream side. The blow-by gas passed through the ventilation holes 82*a* collides against a collision wall 34 while maintaining a high flow velocity. As the blow-by gas collides against the collision wall 34, the remaining oil intermingled in the blow-by gas contacts the collision wall 34, and drips along the wall surface to be separated from the blow-by gas.

A gap is formed between a lower end of the collision wall 34 and the lower wall plate 81. The blow-by gas passes through the gap and flows into the chamber 84 on the downstream side, and, then, is discharged from the discharge opening 31. By the time the blow-by gas flows through the chamber 84 and is discharged from the discharge opening 31, the oil intermingled in the blow-by gas is mostly liquefied and separated from the blow-by gas by dropping at a low flow velocity and contacting the wall surface.

Figure 12:
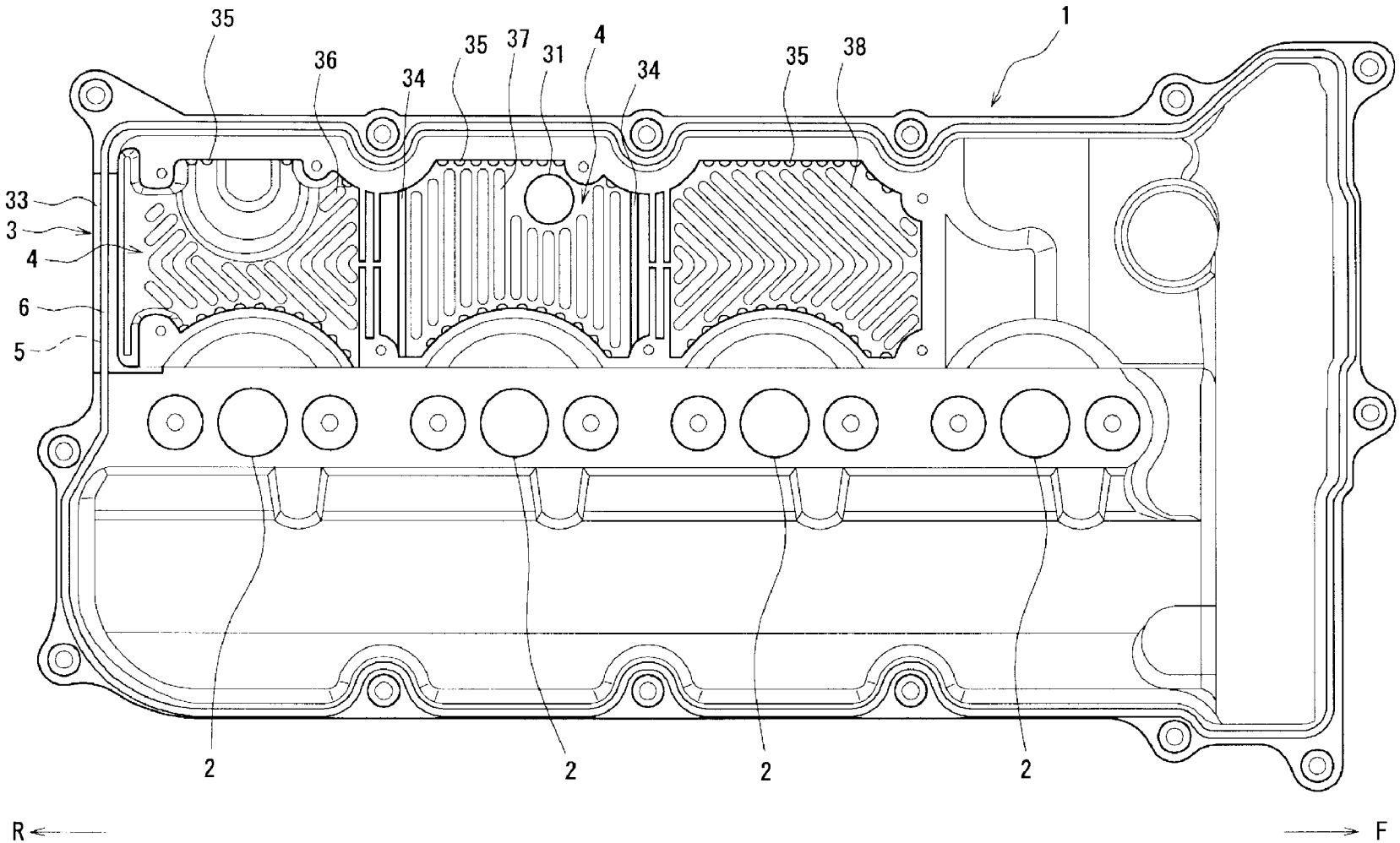
FIG. 12 is a bottom view of the cylinder head cover.

As shown in FIGS. 5 and 12, two or more beads 35-38 are formed on the side walls and the ceiling portion of the oil separating device 8 so that they extend in a direction crossing the blow-by gas flow. It is possible to perform the contacting of the oil more effectively by increasing a surface area of the beads.

Accordingly, it is possible to separate the oil from the blow-by gas in the chambers 83 and 85 more effectively. Even if the remaining oil cannot be separated by the collision wall 34, the oil can be separated by a large space of the chamber 84 and the bead 35 before reaching the discharge opening 31 (refer to FIG. 4). That is, they can improve the separating performance of the oil separating device 8.

Referring to FIG. 5, the oil liquefied in the chamber 83 is partially collected in a drain portion 81*a* located below the chamber 83, and stored to form an oil reservoir as illustrated. A slit-like opening portion 81*b* is formed at a lower end of the drain portion 81*a*, and the oil is dripped and discharged as oil drops therefrom.

The drain portion 81*a* is formed in a shape such that its width narrows as it approaches the opening portion 81*b*, and its discharge opening is choked. Accordingly, it is possible to control the oil drip, and constantly form the oil reservoir to store a suitable amount of the oil in a lower portion thereof. The oil reservoir in the lower portion of the drain portion 81*a* serves as a lid to prevent the oil mist from the opening portion 81*b*. However, when the oil is reserved a predetermined amount or more in the drain portion 81*a*, a portion of the oil reservoir drips by its own weight. Although the chamber 83 has been particularly mentioned as an example here, the drain portion 81*a* corresponding to the chamber 85 functions similar to that of the chamber 83.

Further, the oil liquefied by the collision wall 34 and the beads 35 of the chamber 84 are also collected in the drain portion 81*a* located below the chambers 84, becomes the oil reservoir, and, finally drips and discharged.

Still referring to FIG. 5, the introductory opening portion 86 is formed using an end wall portion of the cylinder head cover 1. If the introductory opening portion is formed in an intermediate portion of the lower wall plate 81, a portion of the blow-by gas flowing opposite toward the discharge opening 31 stagnates in the rear end portion of the hollow portion 4, and a space in which the oil separation is not carried out may be generated.

On the other hand, in this embodiment, since on the rear end side of the cylinder head cover 1, the introductory opening portion 86 is formed by the rear end wall of the cylinder head cover 1 and an end portion of the lower wall plate 81, it is possible to generate blow-by gas flow through the rear end of the hollow portion 4 to the discharge opening 31, and secure the entire hollow portion 4 as an oil separating space.

However, since the housing 7 is attached to the rear end portion of the cylinder head cover 1, and the engaging portion in which the concave face 9*a* and the convex portion 12*a* engage is located below the introductory opening portion 86, the lubricating oil supplied to the engaging portion by the rotation of the rotational drive system such as the connecting shaft 12 and the camshaft 9 may be dispersed from a side of the housing 7 to the introductory opening portion 86 by a centrifugal force. That is, in addition to the oil intermingled in the blow-by gas to be separated in the oil separating device 8, there is a possibility that an excess amount of oil may be unintentionally fed into the introductory opening portion 86.

Thus, in this embodiment, since the baffle 71 is formed in the housing 7 so that it is located below the introductory opening portion 86 and spaced from the introductory opening portion 86 in the vertical direction, and the baffle portion 71 covers the introductory opening portion 86, the unintentional feed of the dispersed oil from the side of the housing 7 into the introductory opening portion 86 by the centrifugal force is prevented. Accordingly, it is possible to prevent the blow-by gas from returning to the air-intake system before the oil has not been separated in the oil separating device 8.

Further, in this embodiment, since the baffle 71 is formed in the housing 7 to which the auxiliary machine unit is mounted, the housing 7 can be used for preventing the blow-by gas from returning to the air-intake system, even if the baffle member is not additionally provided.

Further, by covering the concave face 9*a* and the convex portion 12*a* with the baffle 71, it is possible to prevent the oil from being unintentionally carried into the introductory opening 86, while satisfying the rotational driving state of the auxiliary machine unit by the camshaft 9.

An inclined portion or bottom surface 81*c* is formed integrally with and in the rear end portion of the lower wall plate 81 that constitutes the introductory opening portion 86. The inclined portion 81*c* inclines downwardly along the axial direction of the camshaft 11 toward the introductory opening portion 86. An arched portion or bulge 81*d* is formed continuously with the inclined portion 81*c* and immediately above the baffle 71. The bulge 81*d* has an end surface with an arc shape when viewed from the axial direction of the camshaft 11. The arc shape of the end surface of the bulge 81*d* conforms to the shape of the baffle 71.

Figure 6:
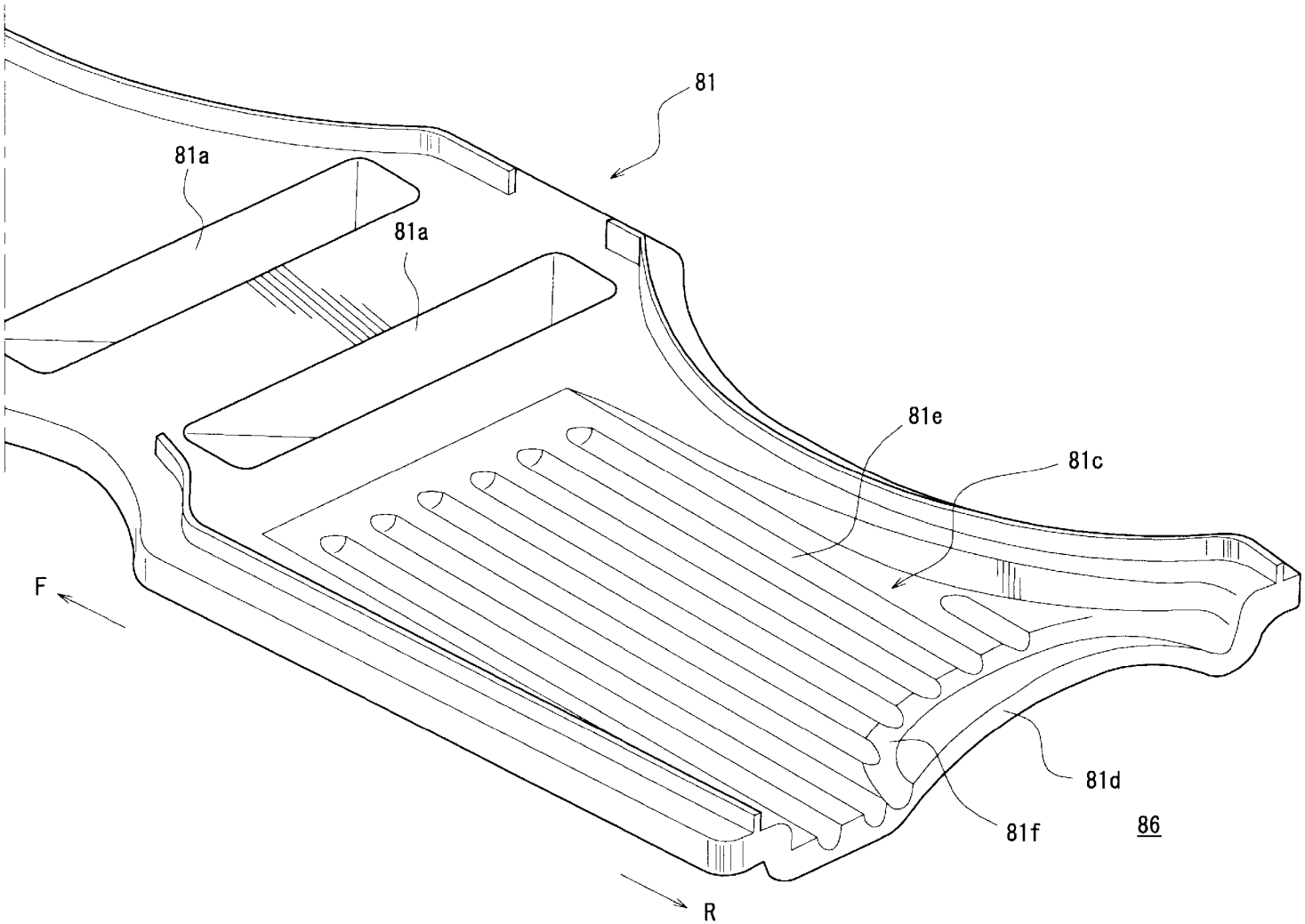
FIG. 6 is a perspective view showing a rear end side of a lower wall plate that forms the introductory opening portion.
Figure 7:
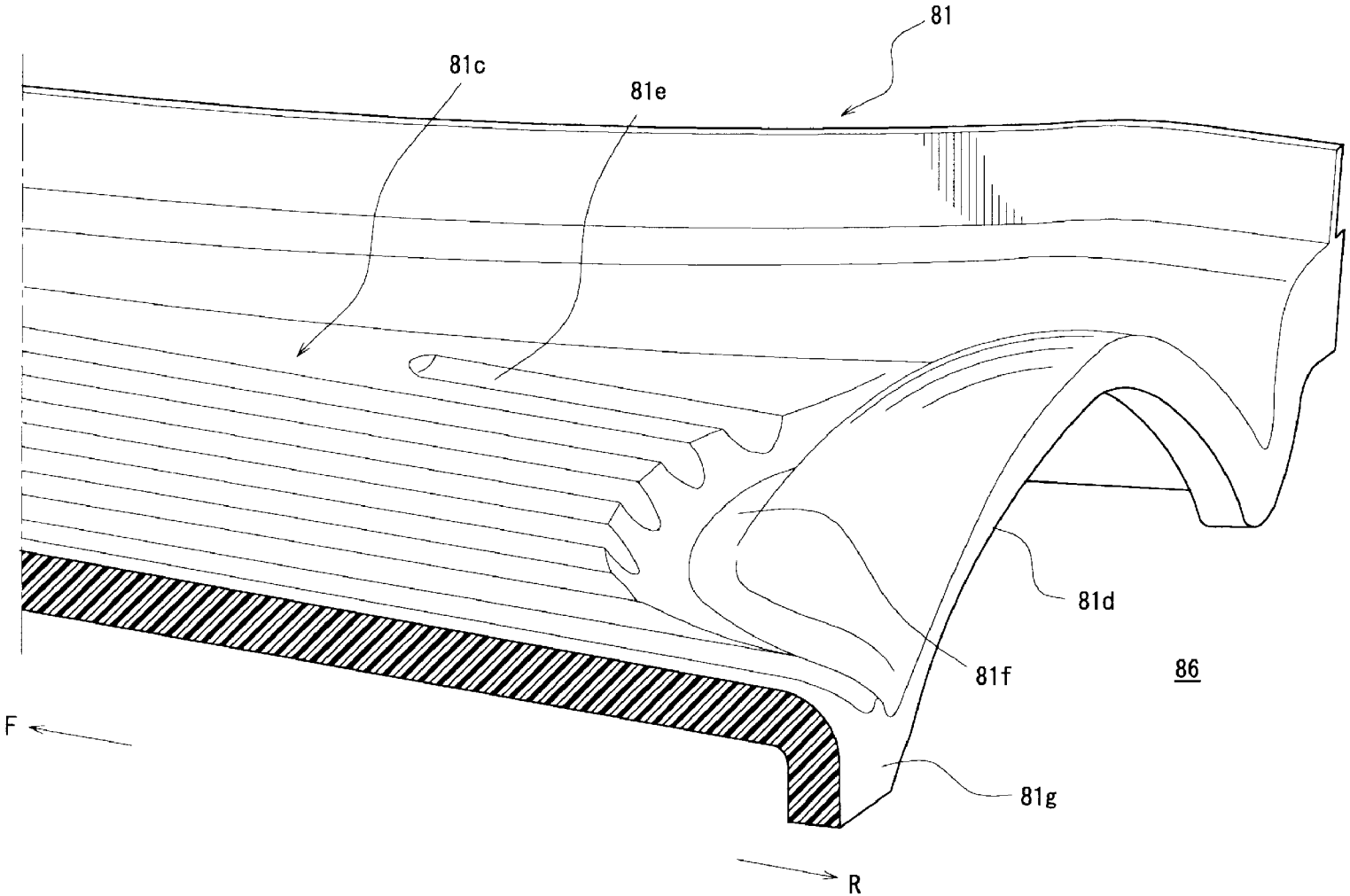
FIG. 7 is an enlarged perspective view showing a proximity to an arched portion on the rear end side of the lower wall plate.

FIG. 6 is a perspective view showing the rear end portion of the lower wall plate 81 that constitutes the introductory opening portion 86, and FIG. 7 is an enlarged perspective view showing a proximity to the arched portion 81*d*. Two or more grooves 81*e* are formed in an upper surface of the inclined portion 81*c* so that they are shaped in a patterned indented surface to collect the oil contacted by sedimentation and dripping to form larger oil drops.

Further, the inclined portion 81*c* (preferably, most of the groove portions 81) is formed up to a lower portion or the circumference of the arched portion 81*d* in the shape of a bulge, and is connected with a second groove 81*f* that is open to an end of the lower wall plate 81. Therefore, the oil collected to the upper surface of the lower wall plate 81, and the oil collected by the beads 35 (refer to FIG. 4) are guided to the rear end of the lower wall plate 81 due to the inclined portion 81*c*. Then, finally, the oil is mostly collected in the second groove 81*f* formed in the lower portion or the circumference of the arched portion 81*d*, and dripped and discharged, as well as from the drain portion 81*a* (refer to FIGS. 4 and 5) and from the introductory opening portion 86.

For example, where a diesel engine is adopted as the engine, because of the characteristics of the diesel engine, an amount of the blow-by gas may rapidly increase from a specific engine speed range, a pressure fluctuation may occur abruptly in the crankcase, as well as in the valve operating chamber (not illustrated) in the cylinder head 11 (refer to FIG. 5), and, thus, a pressure in proximity to the introductory opening portion 86 may increase. At this point, if the oil is dripping and being discharged from the introductory opening portion 86, this oil may be pushed back up with the pressure increase, and, again, returned into the oil separating device 8.

In this embodiment, as mentioned above, since the groove 81*f* is formed in the circumference of the bulge defined by arched portion 81*d*, the oil may be liquefied and may became oil drips that are effectively collected by the circumference of the arched portion 81*d*, to form larger oil drips. Therefore, the amount of oil returned from the introductory opening portion 86 caused by the abrupt pressure increase as mentioned above can be reduced.

Further, since the grooves 81*e* are formed, the liquefied oil can be collected before reaching into the second groove 81*f*, a flow of the oil toward the introductory opening portion 86 can be stimulated by its own weight, and the oil discharging can be improved.

Figure 8:
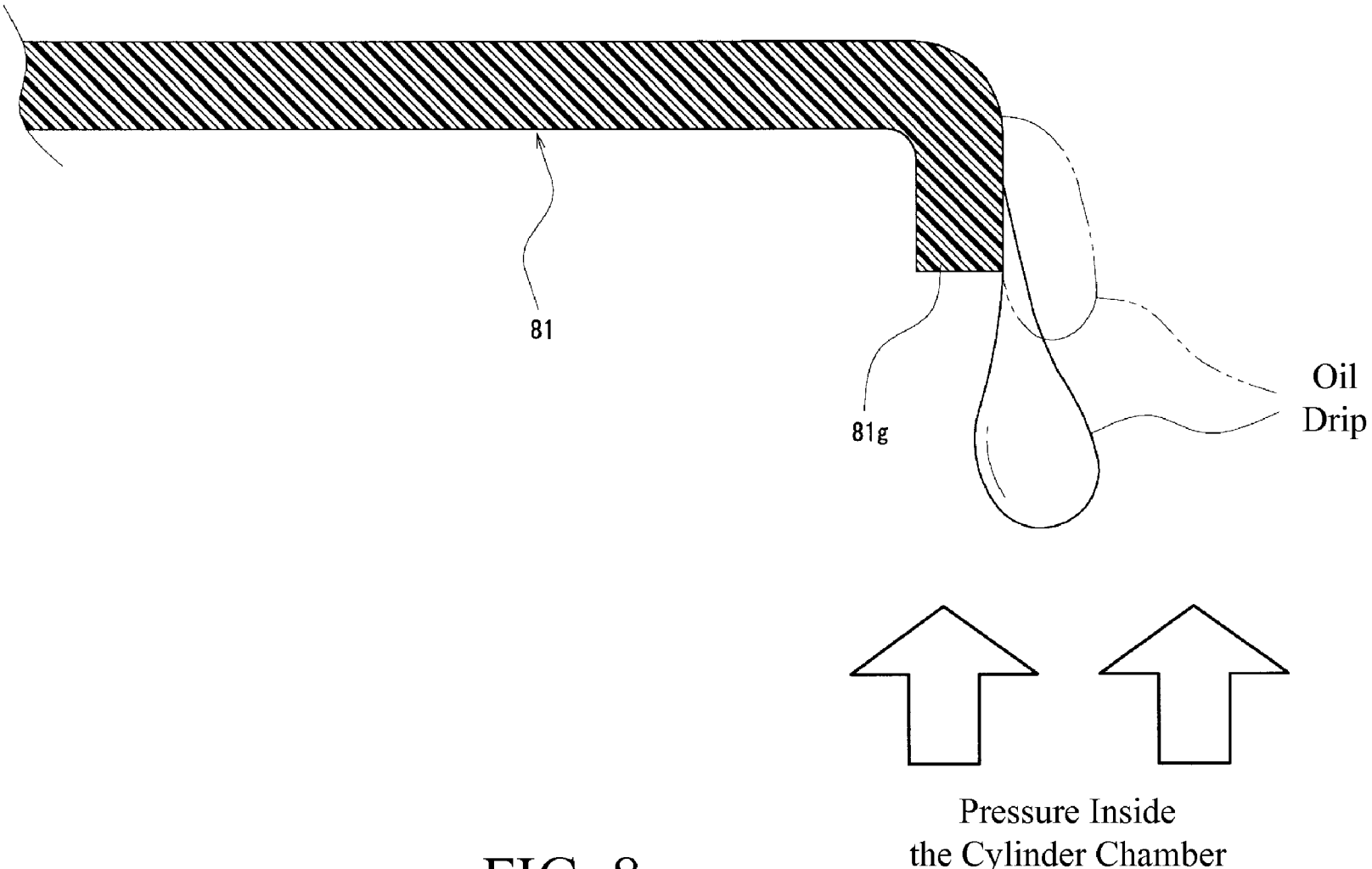
FIG. 8 is an explanatory view for explaining a state in which oil is dripped and discharged along a turned-down portion.

Further, in the end portion of the lower wall plate 81, as shown in FIGS. 7 and 8, the turned-down portion 81*g* is formed in the end portion of the inclined portion 81*c* on the side of the introductory opening portion 86. Since the oil drip to be fell and discharged is located away from the upper surface of the lower wall plate 81, it does not reach back to the upper surface of the lower wall plate 81, even if the abrupt pressure increase occurs as mentioned above, and the oil return can be effectively reduced, as shown by a two-point chain line in FIG. 8.

Figure 9:
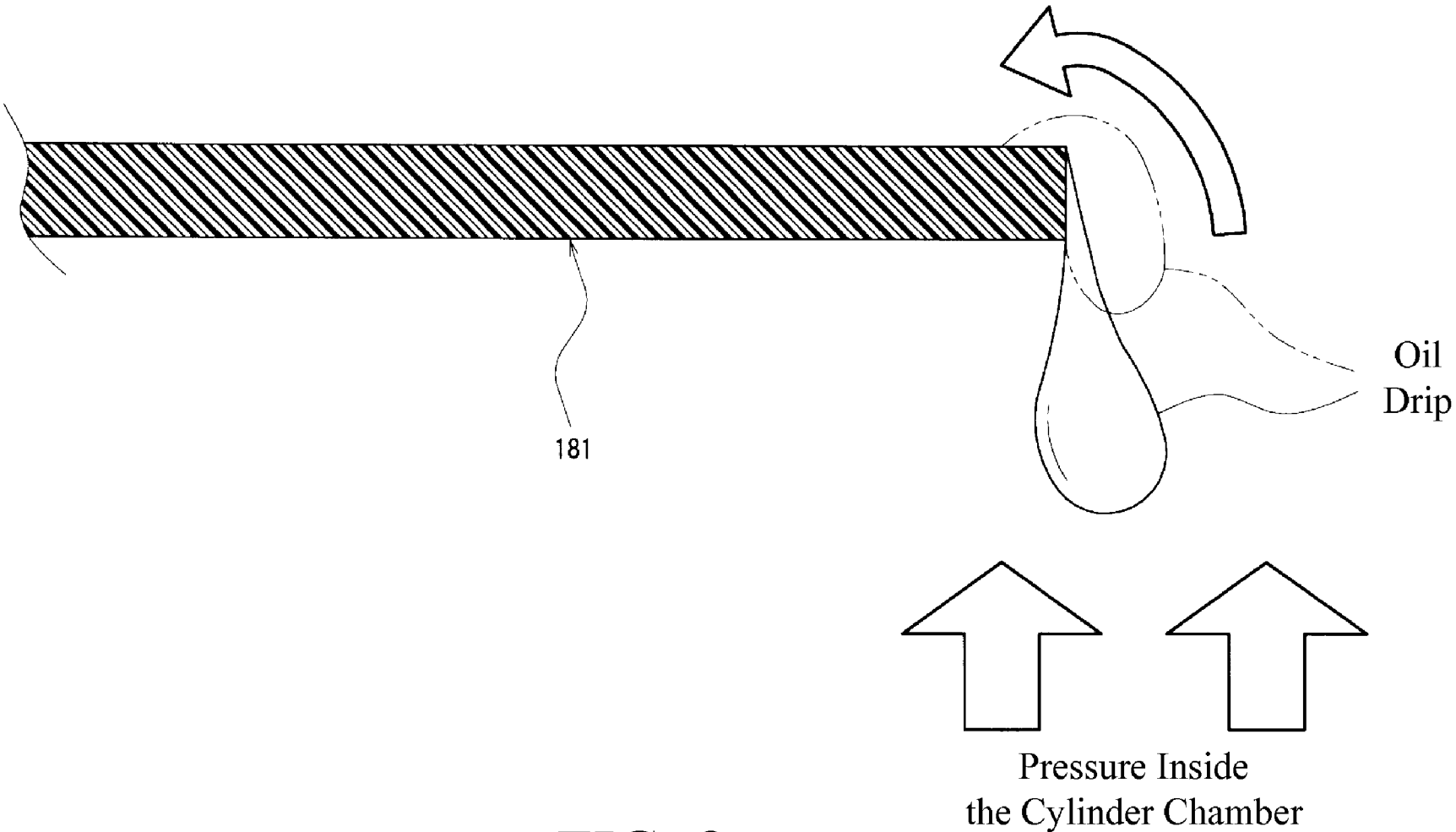
FIG. 9 is an explanatory view for explaining a state in which the oil is dripped and discharged along an end portion of the lower wall plate in which the turned-down portion is not formed.

For example, if the end portion is simply formed in a linear shape as a lower wall plate 181 shown in FIG. 9, the oil drip may easily return to the upper surface of the lower wall plate 181 by the pressure increase as shown by a two-point chain line.

Figure 10:
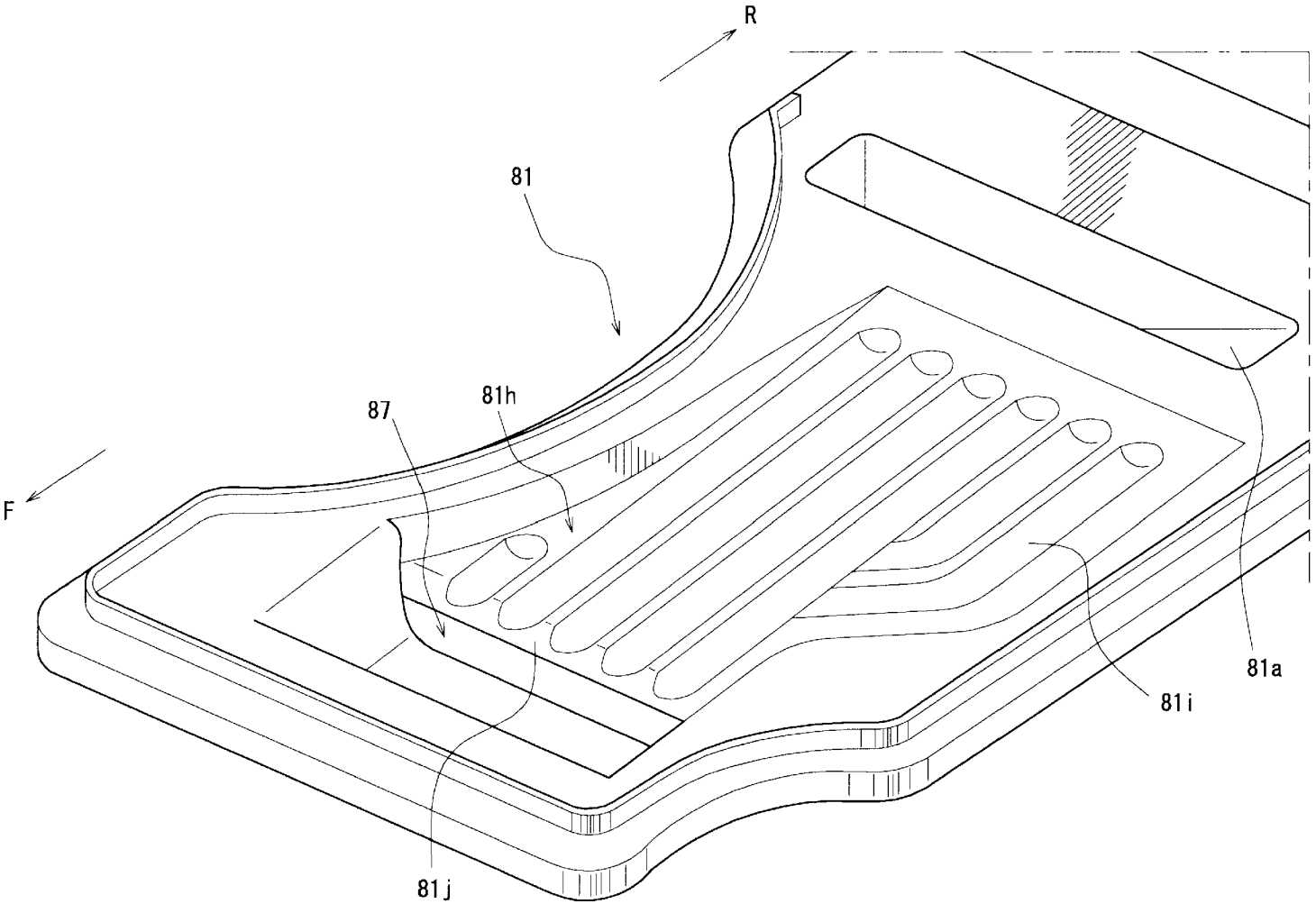
FIG. 10 is a perspective view showing the introductory opening portion on the front end side of the oil separating device.
Figure 11:
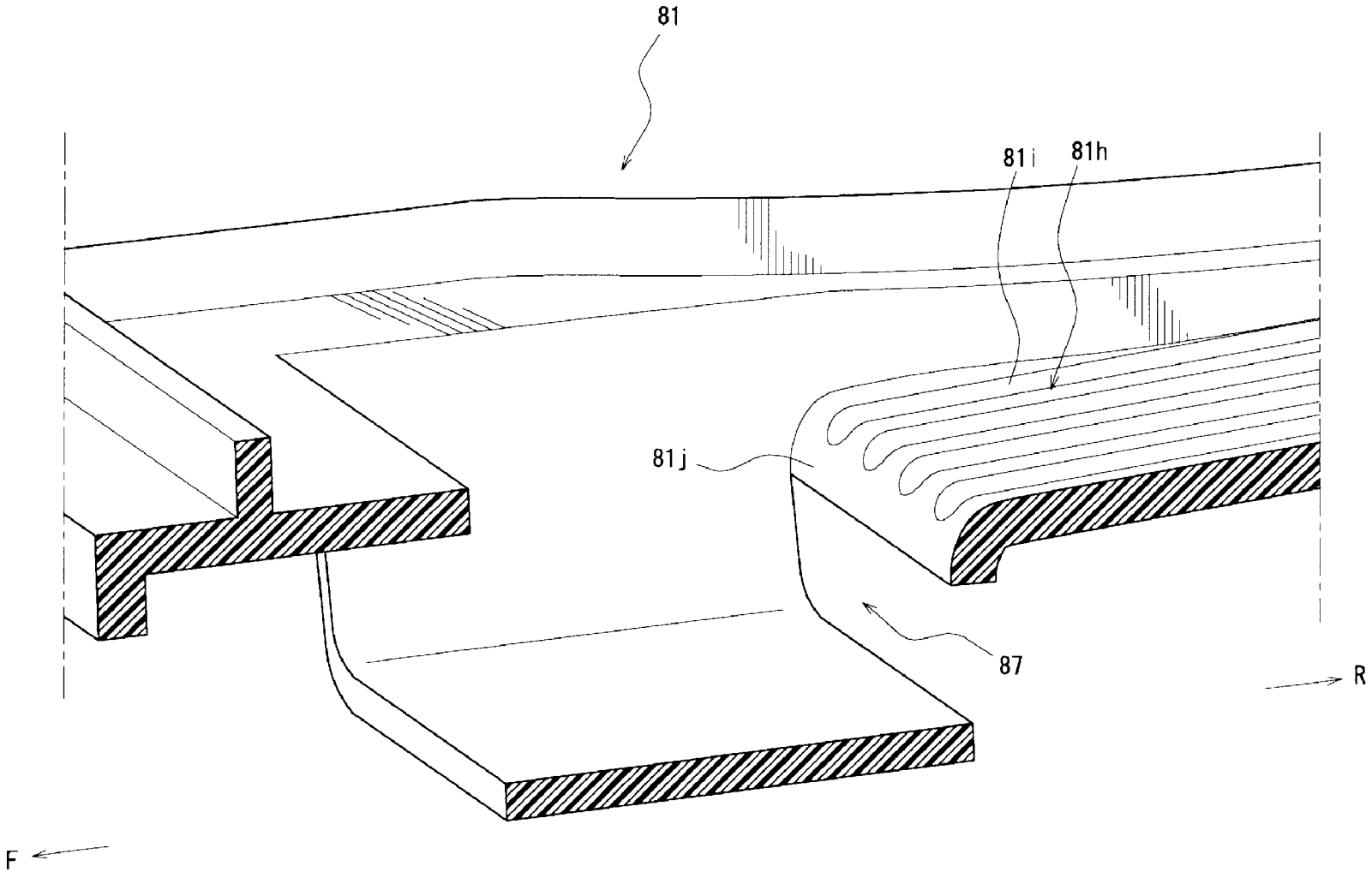
FIG. 11 is a partial cross-sectional view showing the introductory opening portion on the front end side of the oil separating device.

FIG. 10 is a perspective view showing the introductory opening portion 87 on the front end side of the oil separating device 8, and FIG. 11 is a partial cross-sectional view of the introductory opening portion 87. This introductory opening portion 87 is different from the introductory opening portion 86 in that a front end portion of the lower wall plate 8 is partially recessed downwardly, and an opening is formed in the side. However, this introductory opening portion 87 is the same as that of the introductory opening portion 86 in that an inclined portion 81*h* that inclines downwardly toward the introductory opening portion 87, and is provided with two or more grooves 81*i*, and tip ends of the grooves 81*i* are formed with a turned-down portion 81*j*, as illustrated. Of course, the operations of these inclined portion 81*h*, groove portions 81*i*, and turned-down portion 81*j*, etc. are similar to the operations of the inclined portion 81*c*, groove portions 81*f*, and turned-down portion 81*g* of the introductory opening portion 86.

FIG. 12 shows a bottom view of the cylinder head cover 1. As mentioned above, the beads 35 are formed along the side walls of each chambers 83-85 (refer to FIG. 4) in the cylinder head cover 1. It is possible to improve the oil discharge by forming the beads 36-38 in the ceiling portion, as mentioned above.

As illustrated, the beads 36 and 38 may be formed in the ceiling portion corresponding to the chambers 83 and 85 on the upstream side, in a chevron shape or similar shape. This shape guides the liquefied oil toward the side walls on the bead basis by the action of the blow-by gas flow when the blow-by gas flows in and the oil intermingled in the blow-by gas contacts to the ceiling portion. This can prevent the oil mist from reaching the chamber 84. Further, even if the remaining oil that cannot be separated in the chambers 83 and 85 flows into the chamber 84 on the downstream side, since the bead 37 extends to a direction perpendicular to the blow-by gas flow in the chamber 84, the oil easily collides with the ceiling portion, and, thereby, it is possible to prevent the oil flow into the discharge opening 31.

In the embodiment mentioned above, the camshaft 9 and the auxiliary machine unit (connecting shaft 12) constitute a rotational drive system, and the baffle 71 of the housing 7 covers the engaging portion that rotationally drives the auxiliary machine unit. However, the present invention is not necessarily limited to this configuration. For example, where the end portion of the camshaft extends further to the rear, the baffle portion may be formed in a bearing cap that covers the camshaft.

The bearing cap, similar to the housing 7, is a member to shield the camshaft (rotational drive system) from the exterior. In this case, the lubricating oil is supplied from the bearing cap to a journal surface of the camshaft. Therefore, where the bearing cap is located close to the introductory opening portion, there may be a possibility that the lubricating oil is dispersed to the introductory opening portion by the centrifugal force similar to the embodiment mentioned above.

Therefore, by forming the baffle portion in the bearing cap that shields the camshaft from the exterior, it is possible to prevent the oil from being unintentionally fed into the introductory opening portion from the bearing cap side, and to prevent the blow-by gas from being discharged into the air-intake system while intermingling with the oil.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An internal combustion engine, comprising:

a cylinder head;

a rotational shaft supported by said cylinder head and lubricated;

a head cover arranged on said cylinder head;

an end member arranged at an axial end of said rotational shaft;

a first chamber defined at least by said cylinder head and said end member and accommodating said rotational shaft, wherein the end member forms an exterior housing of the cylinder head and shields the first chamber from an exterior of the cylinder head;

a second chamber defined at least by said head cover and having an opening to said first chamber; and a baffle integrally formed with said end member and extending in an axial direction of said rotational shaft between said opening and said rotational shaft in a radial direction of said rotational shaft.

2. The internal combustion engine as described in claim 1, further comprising:

a connecting shaft housed in said end member; and a coupler configured to couple said connecting shaft with said rotational shaft, lubricated, and arranged to be overlapped with said baffle in the axial direction of said rotational shaft.

3. The internal combustion engine as described in claim 2, wherein said coupler consists of a first spline integrally formed with said rotational shaft and a second spline integrally formed with said connecting shaft, said first and second splines being engaged with each other.

4. The internal combustion engine as described in claim 2, farther comprising a sealing member arranged at least partly around said end member and configured to seal said first chamber from the outside.

5. The internal combustion engine as described in claim 4, wherein said baffle has an outer surface contacting with said sealing member, and extending in the axial direction of said rotational shaft.

6. The internal combustion engine as described in claim 1, wherein said baffle has an arc-shaped cross-section with a concave face positioned to face said rotational shaft.

7. The internal combustion engine as described in claim 6, wherein said baffle has an outer surface extending in the axial direction of said rotational shaft.

8. The internal combustion engine as described in claim 6, further comprising:

a wall horizontally extending and defining partly said first and second chambers; and a bulge formed continuously with said wall at a periphery of said opening and having an end surface with an arc shape when viewed from the axial direction of said rotational shaft, said arc shape having a concave face positioned to face said rotational shaft.

9. The internal combustion engine as described in claim 8, further comprising an inclined bottom surface formed on an upper side of said wall defining at least partly said second chamber, said inclined bottom surface being downwardly inclined toward said bulge in the axial direction of said rotational shaft.

10. The internal combustion engine as described in claim 9, further comprising a groove formed on the bottom surface and extending in the axial direction of said rotational shaft.

11. An internal combustion engine, comprising:

a cylinder head;

a rotational shaft supported by said cylinder head and lubricated;

a head cover arranged on said cylinder head;

a first chamber defined at least by said cylinder head and accommodating said rotational shaft;

a second chamber defined at least by said head cover and having an opening to said first chamber; and a baffle formed integrally with an end member that forms an exterior housing of the cylinder head and is configured to shield the first chamber from an exterior of the cylinder head, the baffle extending inward from the end member in the axial direction of said rotational shaft, and having an arc-shaped cross-section viewed in an axial direction of said rotational shaft, and located between said opening and said rotational shaft in a radial direction of said rotational shaft, said arc-shaped cross-section having a concave face positioned to face said rotational shaft.

12. The internal combustion engine as described in claim 11, wherein said baffle has an outer surface extending in the axial direction of said rotational shaft.

13. The internal combustion engine as described in claim 11, further comprising:

a wall horizontally extending and defining partly said first and second chambers; and a bulge formed continuously with said wall at a periphery of said opening and having an end surface with an arc shape when viewed from the axial direction of said rotational shaft, said arc shape having a concave face positioned to face said rotational shaft.

14. The internal combustion engine as described in claim 13, further comprising an inclined bottom surface formed on an upper side of said wall defining at least partly said second chamber, said inclined bottom surface being downwardly inclined toward said bulge in the axial direction of said rotational shaft.

15. An internal combustion engine, comprising:

a cylinder head;

a rotational shaft supported by said cylinder head and lubricated;

a head cover arranged on said cylinder head;

a wall horizontally extending between said cylinder head and said head cover;

a first chamber defined at least by said cylinder head and said wall accommodating said rotational shaft;

a second chamber defined at least by said head cover and said wall;

an opening vertically communicating between said first and second chambers; and a bulge formed continuously with said wall at a periphery of said opening and having an end surface with an arc shape when viewed from the axial direction of said rotational shaft, said arc shape having a concave face positioned to face said rotational shaft.

16. The internal combustion engine as described in claim 15, further comprising an inclined bottom surface formed on an upper side of said wall defining at least partly said second chamber, said inclined bottom surface being downwardly inclined toward said bulge in the axial direction of said rotational shaft.

17. The internal combustion engine as described in claim 16, further comprising a groove formed on said bottom surface and extending in the axial direction of said rotational shaft.

18. The internal combustion engine as described in claim 16, further comprising a groove which is formed at an upper side of said wall, the groove extending around said bulge, and ending at said opening.

19. The internal combustion engine as described in claim 15, further comprising a groove which is formed at an upper side of said wall, the groove extending around said bulge, and ending at said opening.

20. The internal combustion engine as described in claim 15, wherein said end surface extends downwardly beyond a lower surface of said wall.

21. An internal combustion engine, comprising:

a cylinder head;

a rotational shaft supported by said cylinder head and lubricated;

a head cover arranged on said cylinder head;

an end member arranged at an axial end of said rotational shaft;

a first chamber defined at least by said cylinder head and said end member and accommodating said rotational shaft, the end member forming an exterior housing of the cylinder head and being configured to shield the first chamber from an exterior of the cylinder head;

a second chamber defined at least by said head cover and having an opening wherethrough a blow-by gas flows from said first chamber to said second chamber in a radial direction of said rotational shaft; and a baffle integrally formed with said end member and extending in an axial direction of said rotational shaft between said opening and said rotational shaft in a radial direction of said rotational shaft such that said baffle can restrict said flow of said blow-by gas through said opening.

22. An internal combustion engine, comprising:

a cylinder head;

a rotational shaft supported by said cylinder head and lubricated;

a head cover arranged on said cylinder head;

a first chamber defined at least by said cylinder head and accommodating said rotational shaft;

a second chamber defined at least by said head cover and having an opening wherethrough a blow-by gas flows from said first chamber to said second chamber in a radial direction of said rotational shaft; and a baffle extending in the axial direction of said rotational shaft and having an arc-shaped cross-section viewed in an axial direction of said rotational shaft, and located between said opening and said rotational shaft in a radial direction of said rotational shaft such that said baffle can restrict said flow of said blow-by gas through said opening, said arc-shaped cross-section having a concave face positioned to face said rotational shaft.

* * * * *